US007899191B2

(12) United States Patent
Lakaniemi et al.

(10) Patent No.: US 7,899,191 B2
(45) Date of Patent: Mar. 1, 2011

(54) SYNTHESIZING A MONO AUDIO SIGNAL

(75) Inventors: Ari Lakaniemi, Helsinki (FI); Pasi Ojala, Kirkkonummi (FI)

(73) Assignee: Nokia Corporation, Espoo (FI)

( * ) Notice: Subject to any disclaimer, the term of this patent is extended or adjusted under 35 U.S.C. 154(b) by 1205 days.

(21) Appl. No.: 10/592,255

(22) PCT Filed: Mar. 12, 2004

(86) PCT No.: PCT/IB2004/000715

§ 371 (c)(1),
(2), (4) Date: Sep. 7, 2006

(87) PCT Pub. No.: WO2005/093717

PCT Pub. Date: Oct. 6, 2005

(65) Prior Publication Data

US 2007/0208565 A1 Sep. 6, 2007

(51) Int. Cl.
*H04R 5/00* (2006.01)

(52) U.S. Cl. ..... 381/23; 381/80; 704/500

(58) Field of Classification Search ..... 381/22–23, 381/80, 119, 94.1–94.3; 704/500–504
See application file for complete search history.

(56) References Cited

U.S. PATENT DOCUMENTS 5,274,740 A * 12/1993 Davis et al. ..... 704/203
5,583,962 A * 12/1996 Davis et al. ..... 704/229
5,878,080 A 3/1999 Ten Kate
5,899,969 A * 5/1999 Fielder et al. ..... 704/225
6,765,930 B1 * 7/2004 Oikawa ..... 370/479
7,031,905 B2 * 4/2006 Tanaka et al. ..... 704/503
7,337,118 B2 * 2/2008 Davidson et al. ..... 704/258
7,447,321 B2 * 11/2008 Furge et al. ..... 381/86

FOREIGN PATENT DOCUMENTS

EP 1 376 538 1/2004
EP 1 377 123 1/2004

OTHER PUBLICATIONS

3GPP TS 26.290 V1.0.0 (Jun. 2004), "3rd Generation Partnership Project; Technical Specification Group Service and System Aspects; Audio codec processing functions; Extended AMR Wideband codec; Transcoding functions (Release 6)" XP-002301758, pp. 1-72.
Canadian Patent Application No. 2,555,182 Office Action dated Oct. 15, 2008, 4 pages.

* cited by examiner

*Primary Examiner*—Xu Mei

(57) ABSTRACT

The invention relates to a method of synthesizing a mono audio signal 3 based on an available encoded multichannel audio signal 2. The encoded multichannel audio signal 2 is assumed to comprise at least for a part of an audio frequency band separate parameter values for each channel of the multichannel audio signal. In order to reduce the processing load in synthesizing the mono audio signal 2, it is proposed that the parameter values of the multiple channels are combined at least for a part of an audio frequency band in the parameter domain. The combined parameter values are then used for synthesizing the mono audio signal. The invention relates equally to a corresponding audio decoder, to a corresponding coding system and to a corresponding software program product.

19 Claims, 9 Drawing Sheets

SYNTHESIZING A MONO AUDIO SIGNAL

CROSS-REFERENCE TO RELATED APPLICATION

This patent application is the U.S. National Stage of International Application Number PCT/IB2004/000715 filed Mar. 12, 2004 and published in English on Oct. 6, 2005 as International Publication Number WO 2005/093717 A1.

FIELD OF THE INVENTION

The invention relates to a method of synthesizing a mono audio signal based on an available encoded multichannel audio signal, which encoded multichannel audio signal comprises, at least for a part of an audio frequency band, separate parameter values for each channel of the multichannel audio signal. The invention relates equally to a corresponding audio decoder, to a corresponding coding system and to a corresponding software program product.

BACKGROUND OF THE INVENTION

Audio coding systems are well known from the state of the art. They are used in particular for transmitting or storing audio signals.

An audio coding system which is employed for transmission of audio signals comprises an encoder at a transmitting end and a decoder at a receiving end. The transmitting end and the receiving end can be for instance mobile terminals. An audio signal that is to be transmitted is provided to the encoder. The encoder is responsible for adapting the incoming audio data rate to a bitrate level at which the bandwidth conditions in the transmission channel are not violated. Ideally, the encoder discards only irrelevant information from the audio signal in this encoding process. The encoded audio signal is then transmitted by the transmitting end of the audio coding system and received at the receiving end of the audio coding system. The decoder at the receiving end reverses the encoding process to obtain a decoded audio signal with little or no audible degradation.

If the audio coding system is employed for archiving audio data, the encoded audio data provided by the encoder is stored in some storage unit, and the decoder decodes audio data retrieved from this storage unit, for instance for presentation by some media player. In this alternative, it is the objective that the encoder achieves a bitrate which is as low as possible, in order to save storage space.

Depending on the allowed bitrate, different encoding schemes can be applied to an audio signal.

In most cases, a lower frequency band and a higher frequency band of an audio signal correlate with each other. Audio codec bandwidth extension algorithms therefore typically first split the bandwidth of the to be encoded audio signal into two frequency bands. The lower frequency band is then processed independently by a so called core codec, while the higher frequency band is processed using knowledge about the coding parameters and signals from the lower frequency band. Using parameters from the low frequency band coding in the high frequency band coding reduces the bit rate resulting in the high band encoding significantly.

FIG. 1 presents a typical split band encoding and decoding system. The system comprises an audio encoder 10 and an audio decoder 20. The audio encoder 10 includes a two band analysis filterbank 11, a low band encoder 12 and a high band encoder 13. The audio decoder 20 includes a low band decoder 21, a high band decoder 22 and a two band synthesis filterbank 23. The low band encoder 12 and decoder 21 can be for example the Adaptive Multi-Rate Wideband (AMR-WB) standard encoder and decoder, while the high band encoder 13 and decoder 22 may comprise either an independent coding algorithm, a bandwidth extension algorithm or a combination of both. By way of example, the presented system is assumed to use the extended AMR-WB (AMR-WB+) codec as a split band coding algorithm.

An input audio signal 1 is first processed by the two-band analysis filterbank 11, in which the audio frequency band is split into a lower frequency band and a higher frequency band. For illustration, FIG. 2 presents an example of a frequency response of a two-band filterbank for the case of AMR-WB+. A 12 kHz audio band is divided into a 0 kHz to 6.4 kHz band L and a 6.4 kHz to 12 kHz band H. In the two-band analysis filterbank 11, the resulting frequency bands are moreover critically down-sampled. That is, the low frequency band is down-sampled to 12.8 kHz and the high frequency band is re-sampled to 11.2 kHz.

The low frequency band and the high frequency band are then encoded independently of each other by the low band encoder 12 and the high band encoder 13, respectively.

The low band encoder 12 comprises to this end full source signal encoding algorithms. The algorithms include an algebraic code excitation linear prediction (ACELP) type of algorithm and a transform based algorithm. The actually employed algorithm is selected based on the signal characteristics of the respectively input audio signal. The ACELP algorithm is typically selected for encoding speech signals and transients, while the transform based algorithm is typically selected for encoding music and tone-like signals to better handle the frequency resolution.

In an AMR-WB+ codec, the high band encoder 13 utilizes a linear prediction coding (LPC) to model the spectral envelope of the high frequency band signal. The high frequency band can then be described by means of LPC synthesis filter coefficients which define the spectral characteristics of the synthesized signal, and gain factors for an excitation signal which control the amplitude of the synthesized high frequency band audio signal. The high band excitation signal is copied from the low band encoder 12. Only the LPC coefficients and the gain factors are provided for transmission.

The output of the low band encoder 12 and of the high band encoder 13 are multiplexed to a single bit stream 2.

The multiplexed bit stream 2 is transmitted for example through a communication channel to the audio decoder 20, in which the low frequency band and the high frequency band are decoded separately.

In the low band decoder 21, the processing in the low band encoder 12 is reversed for synthesizing the low frequency band audio signal.

In the high band decoder 22, an excitation signal is generated by re-sampling a low frequency band excitation provided by the low band decoder 21 to the sampling rate used in the high frequency band. That is, the low frequency band excitation signal is reused for decoding of the high frequency band by transposing the low frequency band signal to the high frequency band. Alternatively, a random excitation signal could be generated for the reconstruction of the high frequency band signal. The high frequency band signal is then reconstructed by filtering the scaled excitation signal through the high band LPC model defined by the LPC coefficients.

In the two band synthesis filterbank 23, the decoded low frequency band signals and the high frequency band signals are up-sampled to the original sampling frequency and combined to a synthesized output audio signal 3.

The input audio signal 1 which is to be encoded can be a mono audio signal or a multichannel audio signal containing at least a first and a second channel signal. An example of a multichannel audio signal is a stereo audio signal, which is composed of a left channel signal and a right channel signal.

For a stereo operation of an AMR-WB+ codec, the input audio signal is equally split into a low frequency band signal and a high frequency band signal in the two band analysis filterbank 11. The low band encoder 12 generates a mono signal by combining the left channel signals and the right channel signals in the low frequency band. The mono signal is encoded as described above. In addition, the low band encoder 12 uses a parametric coding for encoding the differences of the left and right channel signals to the mono signal. The high band encoder 13 encodes the left channel and the right channel separately by determining separate LPC coefficients and gain factors for each channel.

In case the input audio signal 1 is a multichannel audio signal, but the device which is to present the synthesized audio signal 3 does not support a multichannel audio output, the incoming multichannel bit stream 2 has to be converted by the audio decoder 20 into a mono audio signal. At the low frequency band, the conversion of the multichannel signal to a mono signal is straightforward, since the low band decoder 21 can simply omit the stereo parameters in the received bit stream and decode only the mono part. But for the high frequency band, more processing is required, as no separate mono signal part of the high frequency band is available in the bit stream.

Conventionally, the stereo bit stream for the high frequency band is decoded separately for left and right channel signals, and the mono signal is then created by combining the left and right channel signals in a down-mixing process. This approach is illustrated in FIG. 3.

FIG. 3 schematically presents details of the high band decoder 22 of FIG. 1 for a mono audio signal output. The high band decoder comprises to this end a left channel processing portion 30 and a right channel processing portion 33. The left channel processing portion 30 includes a mixer 31, which is connected to an LPC synthesis filter 32. The right channel processing portion 33 includes equally a mixer 34, which is connected to an LPC synthesis filter 35. The output of both LPC synthesis filters 32, 35 is connected to a further mixer 36.

A low frequency band excitation signal which is provided by the low band decoder 21 is fed to either of the mixers 31 and 34. The mixer 31 applies the gain factors for the left channel to the low frequency band excitation signal. The left channel high band signal is then reconstructed by the LPC synthesis filter 32 by filtering the scaled excitation signal through a high band LPC model defined by the LPC coefficients for the left channel. The mixer 34 applies the gain factors for the right channel to the low frequency band excitation signal. The right channel high band signal is then reconstructed by the LPC synthesis filter 35 by filtering the scaled excitation signal through a high band LPC model defined by the LPC coefficients for the right channel.

The reconstructed left channel high frequency band signal and the reconstructed right channel high frequency band signal are then converted by the mixer 36 into a mono high frequency band signal by computing their average in the time domain.

This is, in principle, a simple and working approach. However, it requires a separate synthesizing of multiple channels, even though, in the end, only a single channel signal is needed.

Furthermore, if the multichannel audio input signal 1 is unbalanced in such a way that most of the energy of the multichannel audio signal lies on one of the channels, a direct mixing of multichannels by computing their average will result in an attenuation in the combined signal. In an extreme case, one of the channels is completely silent, which leads to an energy level of the combined signal which is half of the energy level of the original active input channel.

SUMMARY OF THE INVENTION

It is an object of the invention to reduce the processing load which is required for synthesizing a mono audio signal based on an encoded multichannel audio signal.

A method of synthesizing a mono audio signal based on an available encoded multichannel audio signal is shown, which encoded multichannel audio signal comprises at least for a part of an audio frequency band separate parameter values for each channel of the multichannel audio signal. The method comprises, at least for a part of an audio frequency band, combining parameter values of the multiple channels in the parameter domain. The method further comprises for this part of an audio frequency band using the combined parameter values for synthesizing a mono audio signal.

Moreover, an audio decoder for synthesizing a mono audio signal based on an available encoded multichannel audio signal is shown. The encoded multichannel audio signal comprises at least for a part of the frequency band of an original multichannel audio signal separate parameter values for each channel of the multichannel audio signal. The audio decoder comprises at least one parameter selection portion adapted to combine parameter values of the multiple channels in the parameter domain at least for a part of the frequency band of the multichannel audio signal. The audio decoder further comprises an audio signal synthesis portion adapted to synthesize a mono audio signal at least for a part of the frequency band of the multichannel audio signal based on combined parameter values provided by the parameter selection portion.

Moreover, a coding system is shown, which comprises in addition to the disclosed decoder an audio encoder providing the encoded multichannel audio signal.

Finally, a software program product is shown, in which a software code for synthesizing a mono audio signal based on an available encoded multichannel audio signal is stored. The encoded multichannel audio signal comprises at least for a part of the frequency band of an original multichannel audio signal separate parameter values for each channel of the multichannel audio signal. The software code realizes the steps of the disclosed method when running in an audio decoder.

The encoded multichannel audio signal can be in particular, though not exclusively, an encoded stereo audio signal.

The invention proceeds from the consideration that for obtaining a mono audio signal, a separate decoding of available multiple channels can be avoided, if parameter values which are available for these multiple channels are combined already in the parameter domain before the decoding. The combined parameter values can then be used for a single channel decoding.

It is an advantage of the invention that it allows saving processing load at a decoder and that it reduces the complexity of the decoder. If the multiple channels are stereo channels which are processed in a split band system, for example, approximately half of the processing load required for a high frequency band synthesis filtering can be saved compared to performing the high frequency band synthesis filtering separately for both channels and mixing the resulting left and right channel signals.

In one embodiment of the invention, the parameters comprise gain factors for each of the multiple channels and linear prediction coefficients for each of the multiple channels.

Combining the parameter values may be realized in a static manner, for instance by generally computing the average of the available parameter values over all channels. Advantageously, however, combining the parameter values is controlled for at least one parameter based on information on the respective activity in the multiple channels. This allows achievement of a mono audio signal with spectral characteristics and with a signal level as close as possible to the spectral characteristics and to the signal level in a respective active channel, and thus an improved audio quality of the synthesized mono audio signal.

If the activity in a first channel is significantly higher than in a second channel, the first channel can be assumed to be an active channel, while the second channel can be assumed to be a silent channel which provides basically no audible contribution to the original audio signal. In case a silent channel is present, the parameter values of at least one parameter are advantageously disregarded completely when combining the parameter values. As a result, the synthesized mono signal will be similar to the active channel. In all other cases, the parameter values may be combined for example by forming the average or a weighted average over all channels. For a weighted average, the weight assigned to a channel rises with its relative activity compared to the other channel or channels. Other methods can be used as well for realizing the combining. Equally, parameter values for a silent channel which are not to be discarded may be combined with the parameter values of an active channel by averaging or some other method.

Various types of information may form the information on the respective activity in the multiple channels. It may be given for example by a gain factor for each of the multiple channels, by a combination of gain factors over a short period of time for each of the multiple channels, or by linear prediction coefficients for each of the multiple channels. The activity information may equally be given by the energy level in at least part of the frequency band of the multichannel audio signal for each of the multiple channels, or by separate side information on the activity received from an encoder providing the encoded multichannel audio signal.

For obtaining the encoded multichannel audio signal, an original multichannel audio signal may be split for example into a low frequency band signal and a high frequency band signal. The low frequency band signal may then be encoded in a conventional manner. Also the high frequency band signal may be encoded separately for the multiple channels in a conventional manner, which results in parameter values for each of the multiple channels. At least the encoded high frequency band part of the entire encoded multichannel audio signal may then be treated in accordance with the invention.

It has to be understood, though, that equally multichannel parameter values of a low frequency band part of the entire signal can be treated in accordance with the invention, in order to prevent an imbalance between the low frequency band and the high frequency band, for example an imbalance in the signal level. Alternatively, the parameter values for silent channels in the high frequency band which influence the signal level might not be discarded in principle, but only the parameter values for silent channels which influence the spectral characteristic of the signal.

The invention may be implemented for example, though not exclusively, in an AMR-WB+ based coding system.

Other objects and features of the present invention will become apparent from the following detailed description considered in conjunction with the accompanying drawings.

DETAILED DESCRIPTION OF THE INVENTION

Figure 1:
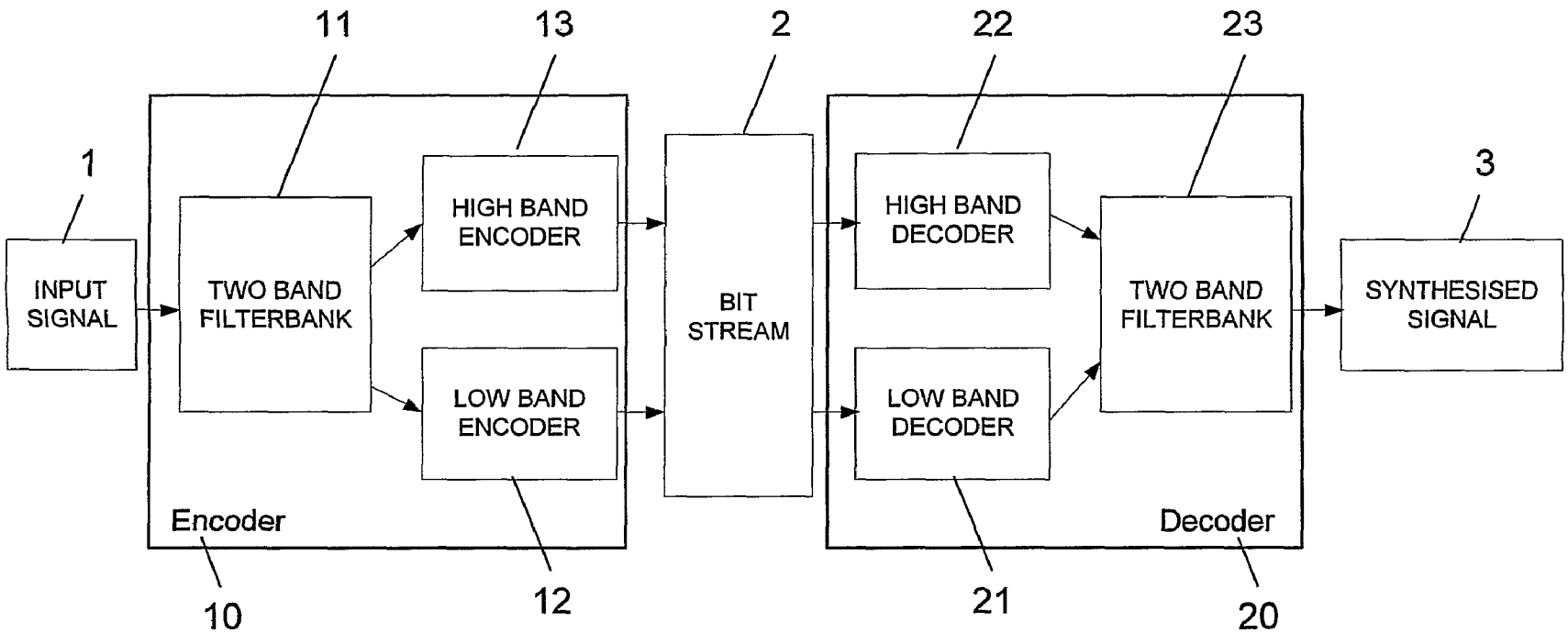
FIG. 1 is a schematic block diagram of a split band coding system.
Figure 2:
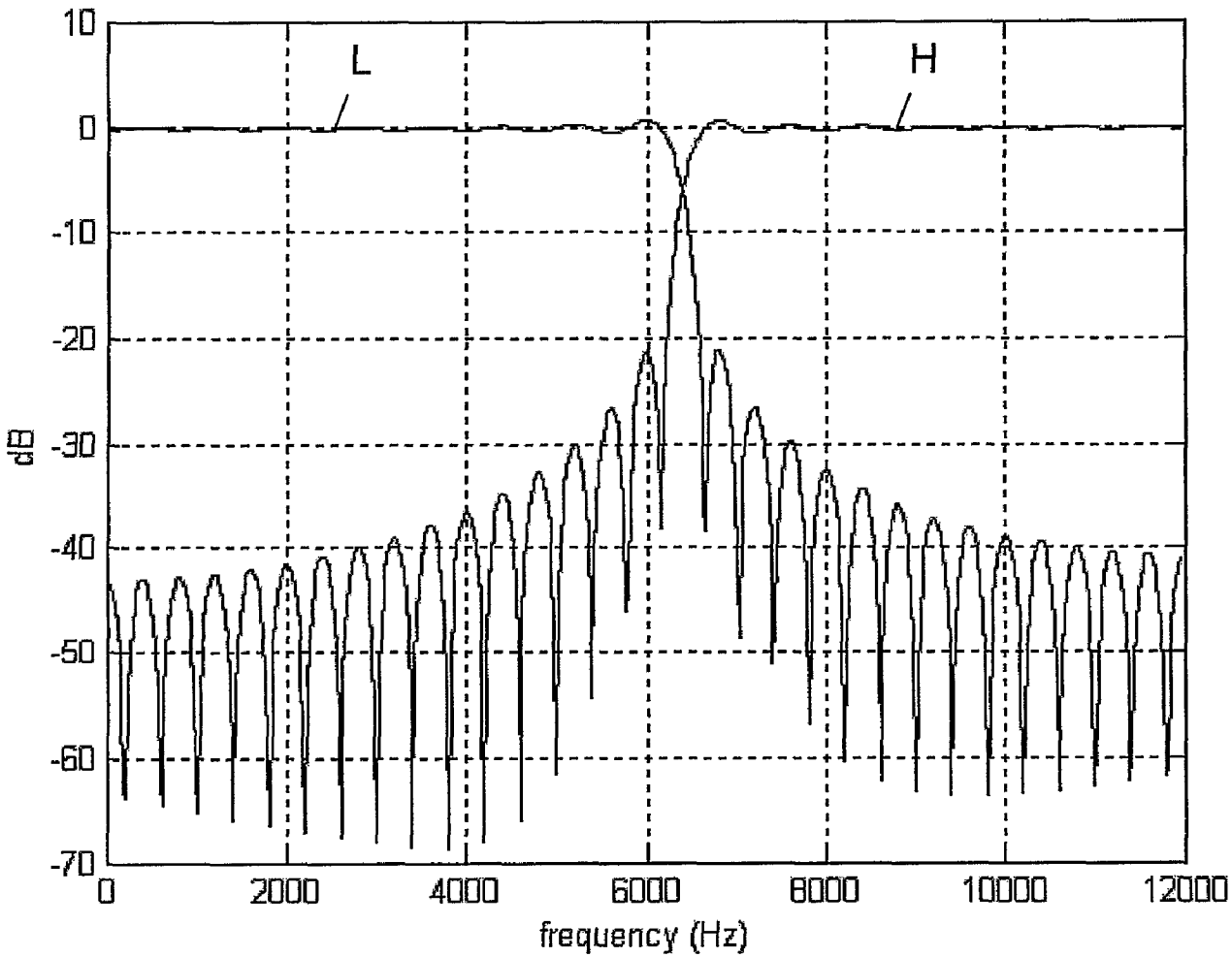
FIG. 2 is a diagram of the frequency response of a two-band filterbank.

The invention is assumed to be implemented in the system of FIG. 1, which will therefore be referred to as well in the following. A stereo input audio signal 1 is provided to the audio encoder 10 for encoding, while a decoded mono audio signal 3 has to be provided by the audio decoder 20 for presentation.

In order to be able to provide such a mono audio signal 3 with a low processing load, the high band decoder 22 of the system may be realized in accordance with a first, simple embodiment of the invention.

Figure 4:
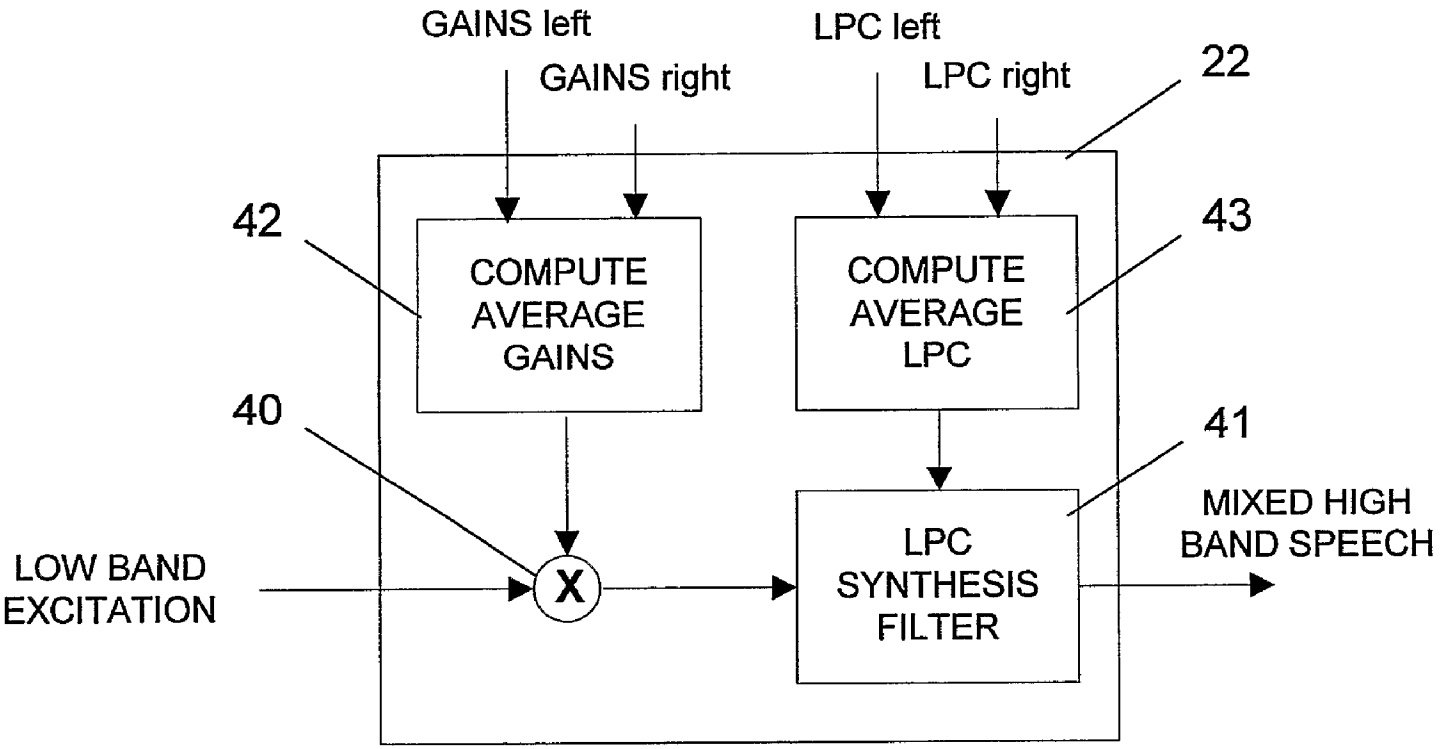
FIG. 4 is a schematic block diagram of high band decoder for stereo to mono conversion according to a first embodiment of the invention.

FIG. 4 is a schematic block diagram of this high band decoder 22. A low band excitation input of the high band decoder 22 is connected via a mixer 40 and an LPC synthesis filter 41 to the output of the high band decoder 22. The high band decoder 22 comprises in addition a gain average computation block 42 which is connected to the mixer and an LPC average computation block 43 which is connected to the LPC synthesis filter 41.

The system operates as follows.

A stereo signal input to the audio encoder 10 is split by the two band analysis filterbank 12 into a low frequency band and a high frequency band. A low band encoder 13 encodes the low frequency band audio signal as described above. An AMR-WB+ high band encoder 12 encodes the high band stereo signal separately for left and right channels. More specifically, it determines gain factors and linear prediction coefficients for each channel as described above.

The encoded mono low frequency band signal, the stereo low frequency band parameter values and the stereo high frequency band parameter values are transmitted in a bit stream 2 to the audio decoder 20.

The low band decoder 21 receives the low frequency band part of the bit stream for decoding. In this decoding, it omits the stereo parameters and decodes only the mono part. The result is a mono low frequency band audio signal.

The high band decoder 22 receives on the one hand the high frequency band parameter values from the transmitted bit stream and on the other hand the low band excitation signal output by the low band decoder 21.

The high frequency band parameters comprise respectively a left channel gain factor, a right channel gain factor, left channel LPC coefficients and right channel LPC coefficients. In the gain average computation block 42, the respective gain factors for the left channel and the right channel are averaged, and the average gain factor is used by the mixer 40 for scaling the low band excitation signal. The resulting signal is provided for filtering to the LPC synthesis filter 41.

In the average LPC computation block 43, the respective linear prediction coefficients for the left channel and the right channel are combined. In AMR-WB+, the combination of the LPC coefficients from both channels can be made for instance by computing the average over the received coefficients in the Immittance Spectral Pair (ISP) domain. The average coefficients are then used for configuring the LPC synthesis filter 41, to which the scaled low band excitation signal is subjected.

The scaled and filtered low band excitation signal forms the desired mono high band audio signal.

The mono low band audio signal and the mono high band audio signal are combined in the two band synthesis filterbank 23, and the resulting synthesized signal 3 is output for presentation.

Figure 3:
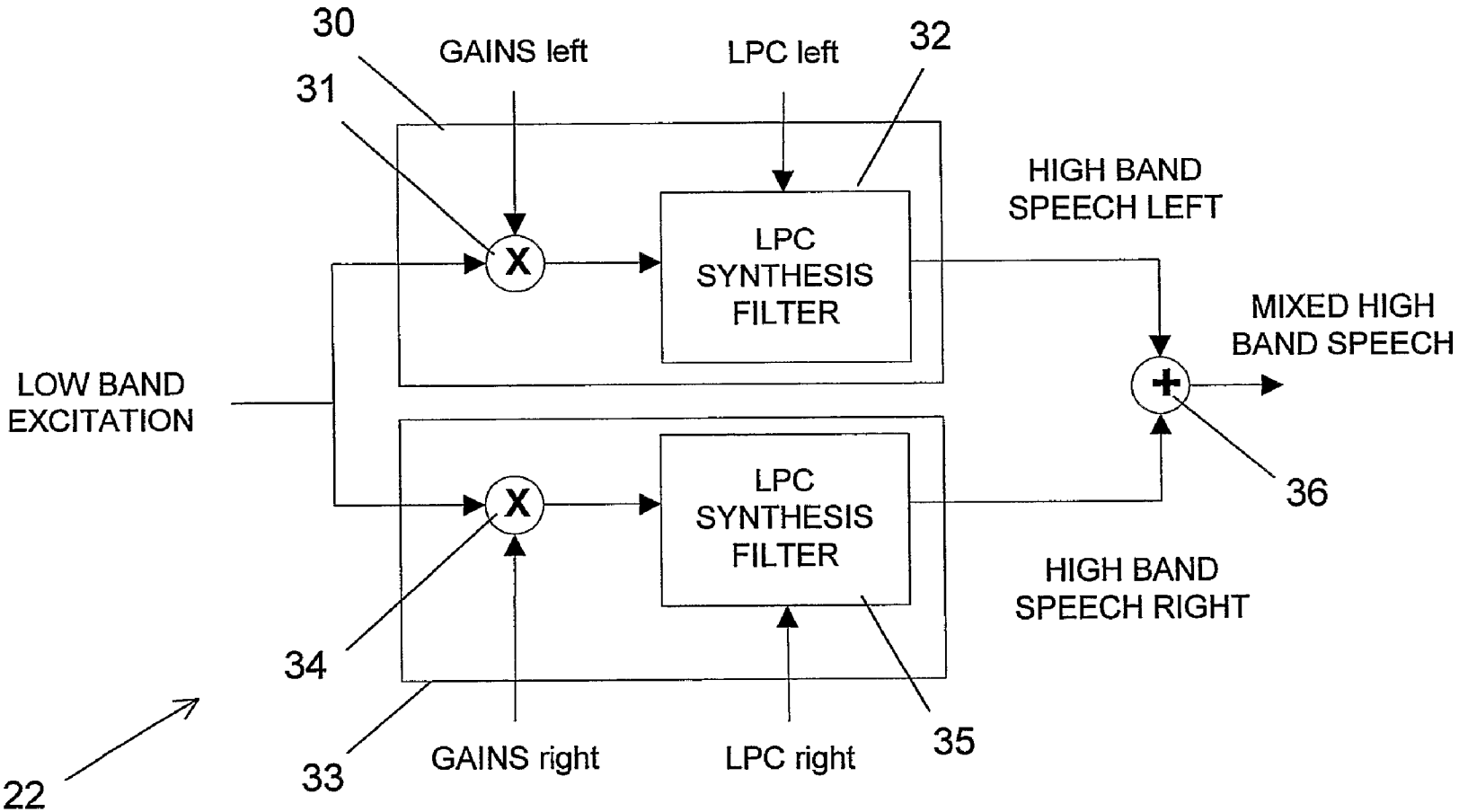
FIG. 3 is a schematic block diagram of a conventional high band decoder for stereo to mono conversion.

Compared to a system using the high band encoder of FIG. 3, a system using the high band encoder of FIG. 4 has the advantage that it requires only approximately half of the processing power for generating the synthesized signal since it is only generated once.

It has to be noted that the above mentioned problem of a possible attenuation in the combined signal in case of a stereo audio input having an active signal in only one of the channels remains, though.

Furthermore, for stereo audio input signals with only one active channel the averaging of linear prediction coefficients brings an undesired side effect of 'flattening' the spectrum in the resulting combined signal. Instead of having the spectral characteristics of the active channel, the combined signal has somewhat distorted spectral characteristics due to the combination of the 'real' spectrum of the active channel and a practically flat or random-like spectrum of the silent channel.

Figure 5:
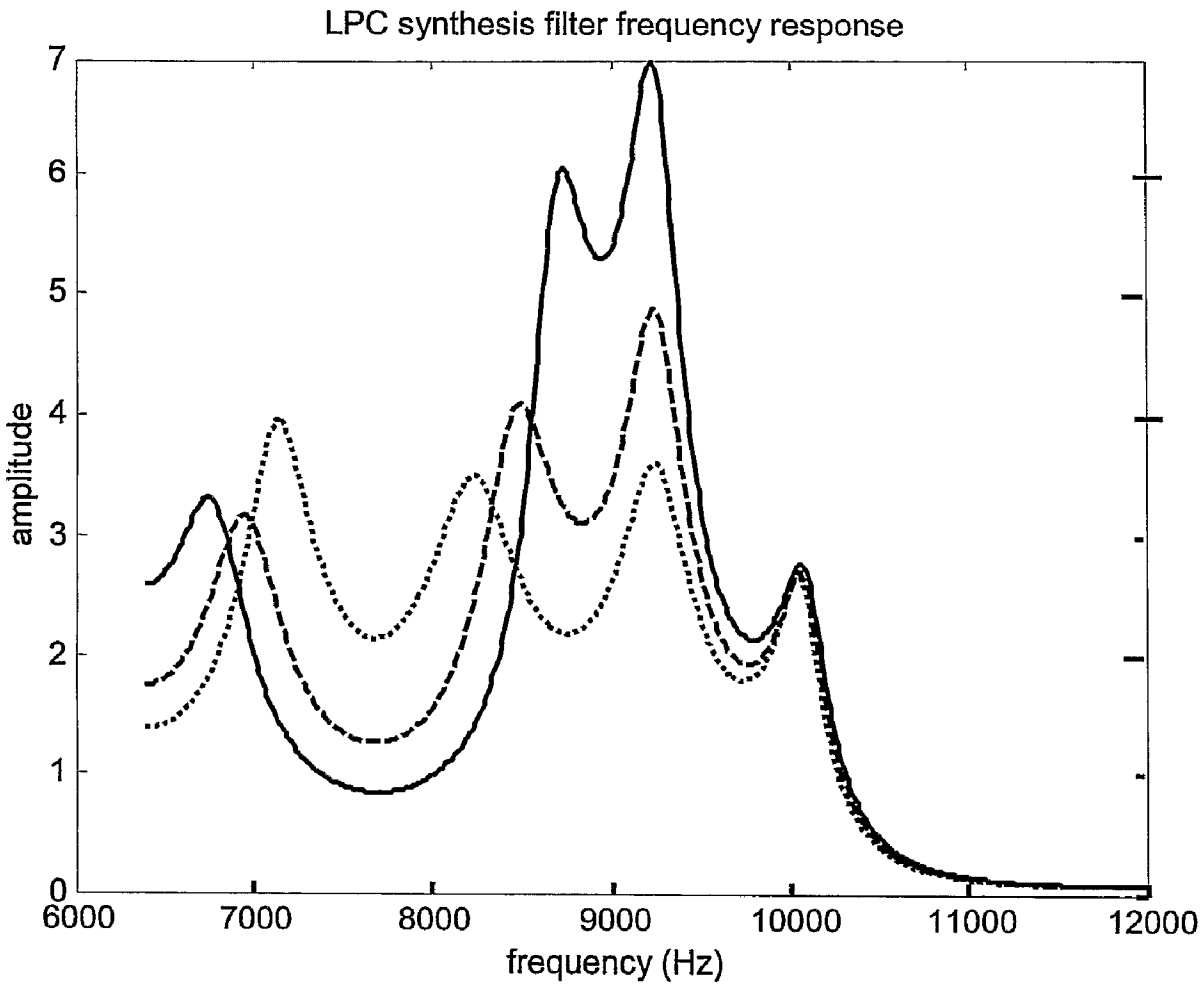
FIG. 5 is a diagram illustrating the frequency response for stereo signals and for the mono signal resulting with the high band decoder of FIG. 4.

This effect is illustrated in FIG. 5. FIG. 5 is a diagram which depicts the amplitude over the frequency for three different LPC synthesis filter frequency responses computed over a frame of 80 ms. A solid line represents the LPC synthesis filter frequency response of an active channel. A dotted line represents the LPC synthesis filter frequency response of a silent channel. A dashed line represents the LPC synthesis filter frequency response resulting when averaging the LPC modules from both channels in the ISP domain. It can be seen that the averaged LPC filter creates a spectrum which does not closely resemble either of the real spectra. In practice this phenomenon can be heard as reduced audio quality at the high frequency band.

In order to be able to provide a mono audio signal 3 not only with a low processing load but further avoiding the constraints which are not solved with the high band decoder of FIG. 4, the high band decoder 22 of the system of FIG. 1 may be realized in accordance with a second embodiment of the invention.

Figure 6:
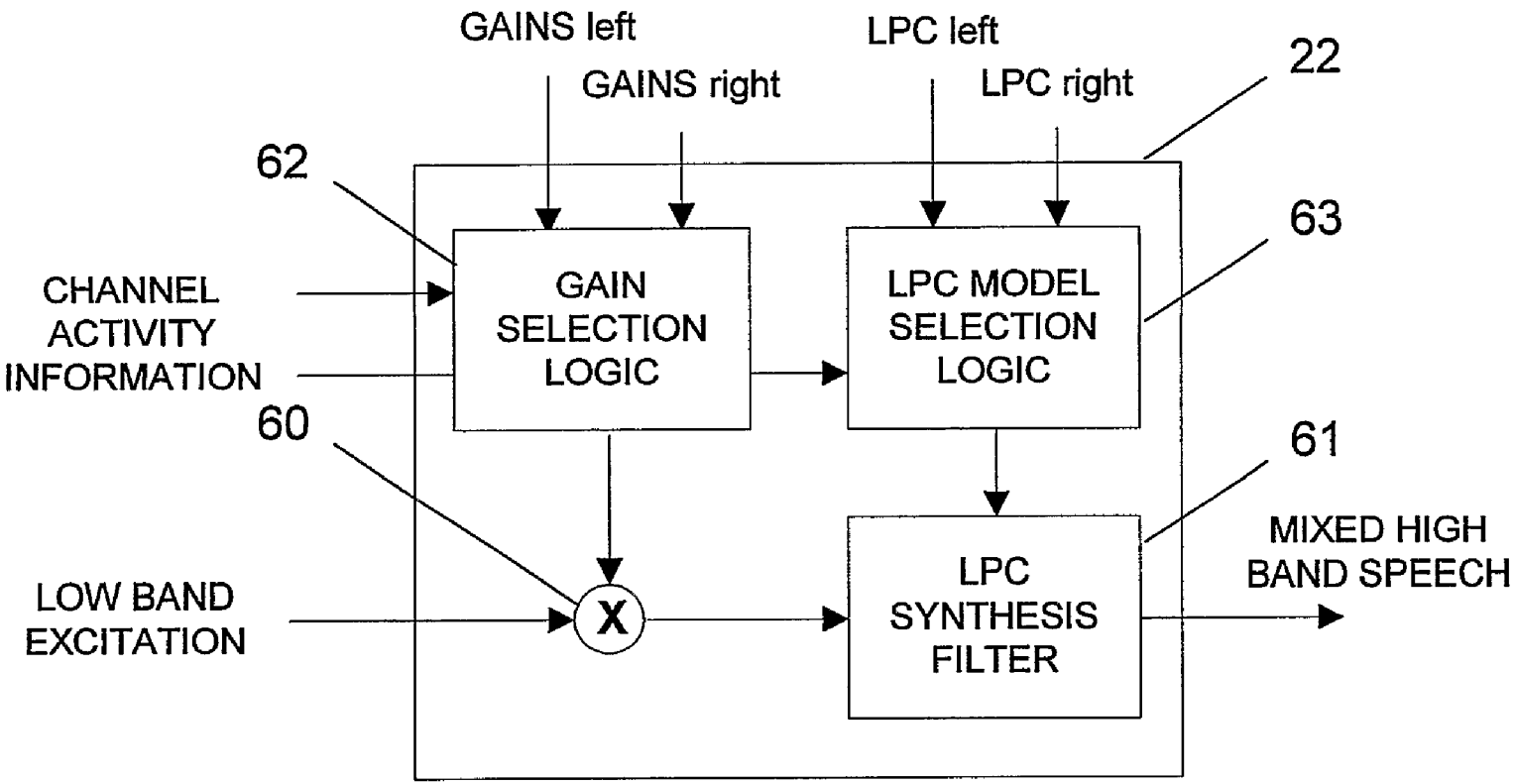
FIG. 6 is a schematic block diagram of high band decoder for stereo to mono conversion according to a second embodiment of the invention.

FIG. 6 is a schematic block diagram of such a high band decoder 22. A low band excitation input of the high band decoder 22 is connected via a mixer 60 and an LPC synthesis filter 61 to the output of the high band decoder 22. The high band decoder 22 comprises in addition a gain selection logic 62 which is connected to the mixer 60, and an LPC selection logic 63 which is connected to the LPC synthesis filter 61.

Figure 7:
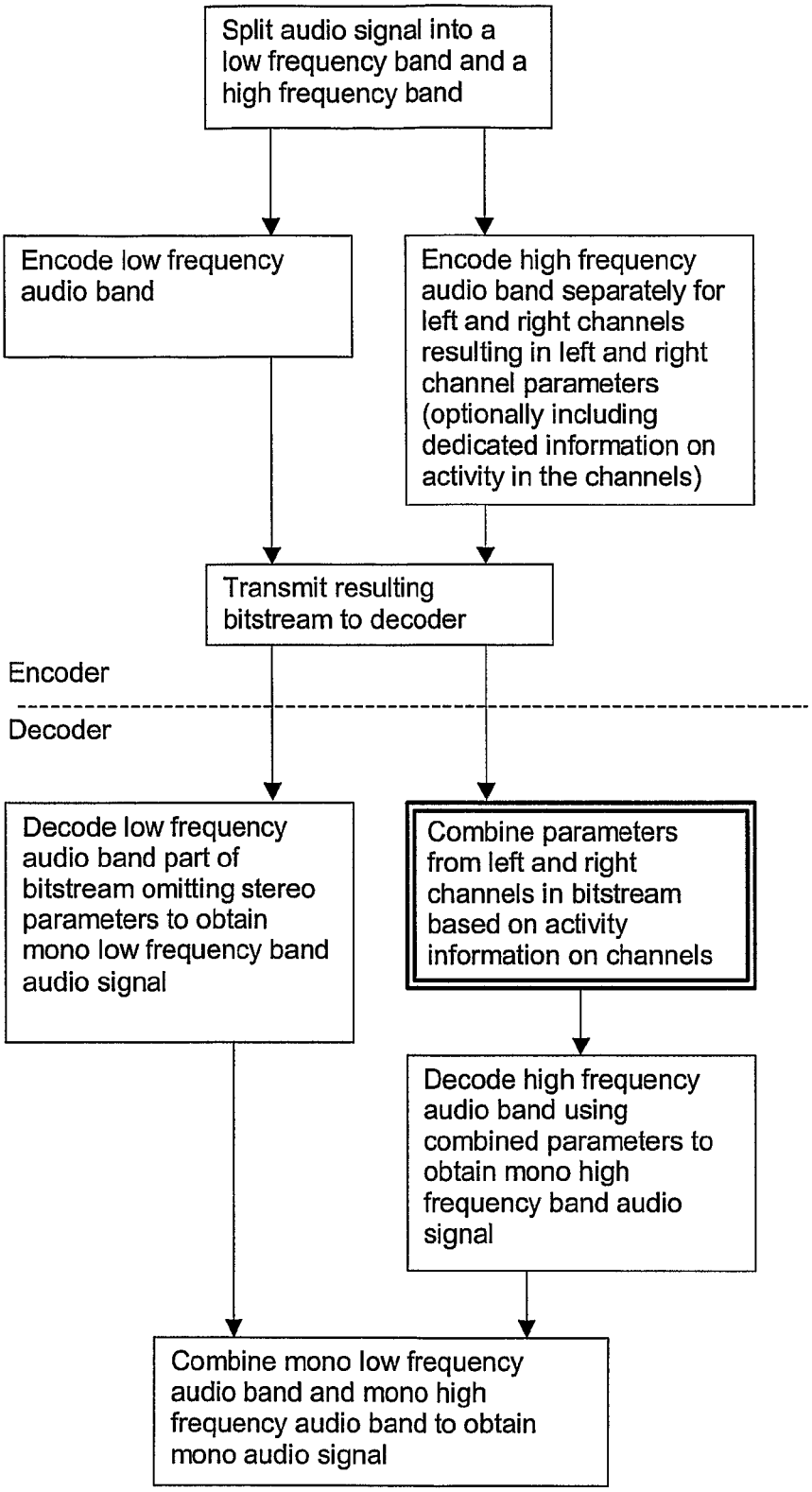
FIG. 7 is a flow chart illustrating the operation in a system using the high band decoder of FIG. 6.

The processing in a system using the high band encoder 22 of FIG. 6 will now be described with reference to FIG. 7. FIG. 7 is a flow chart which depicts in its upper part the processing in the audio encoder 10 and in its lower part the processing in the audio decoder 20 of the system. The upper part and the lower part are divided by a horizontal dashed line.

A stereo audio signal input 1 to the encoder is split into a low frequency band and a high frequency band by the two band analysis filterbank 11. A low band encoder 12 encodes the low frequency band. An AMR-WB+ high band encoder 13 encodes the high frequency band separately for left and right channels. More specifically, it determines dedicated gain factors and linear prediction coefficients for both channels as high frequency band parameters.

The encoded mono low frequency band signal, the stereo low frequency band parameter values and the stereo high frequency band parameter values are transmitted in a bit stream 2 to the audio decoder 20.

The low band decoder 21 receives the low frequency band related part of the bit stream 2, and decodes this part. In the decoding, the low band decoder 21 omits the received stereo parameters and decodes only the mono part. The result is a mono low band audio signal.

The high band decoder 22 receives on the one hand a left channel gain factor, a right channel gain factor, linear prediction coefficients for the left channel and linear prediction coefficients for the right channel, and on the other hand the low band excitation signal output by the low band decoder 21. The left channel gain and the right channel gain are used at the same time as channel activity information. It has to be noted that instead, some other channel activity information indicating the activity distribution in the high frequency band to the left channel and the right channel could be provided as additional parameter by the high band encoder 13.

The channel activity information is evaluated, and the gain factors for the left channel and the right channel are combined by the gain selection logic 62 according to the evaluation to a single gain factor. The selected gain is then applied to the low frequency band excitation signal provided by the low band decoder 21 by means of the mixer 60.

Moreover, the LPC coefficients for the left channel and the right channel are combined by the LPC model selection logic 63 according to the evaluation to a single set of LPC coefficients. The combined LPC model is supplied to the LPC synthesis filter 61. The LPC synthesis filter 61 applies the selected LPC model to the scaled low frequency band excitation signal provided by the mixer 60.

The resulting high frequency band audio signal is then combined in the two band synthesis filterbank 23 with the mono low frequency band audio signal to a mono full band audio signal, which may be output for presentation by a device or an application which is not capable of processing stereo audio signals.

The disclosed evaluation of the channel activity information and the subsequent combination of the parameter values, which are indicated in the flow chart of FIG. 7 as a block with double lines, can be implemented in different ways. Two options will be presented with reference to the flow charts of FIGS. 8 and 9.

Figure 8:
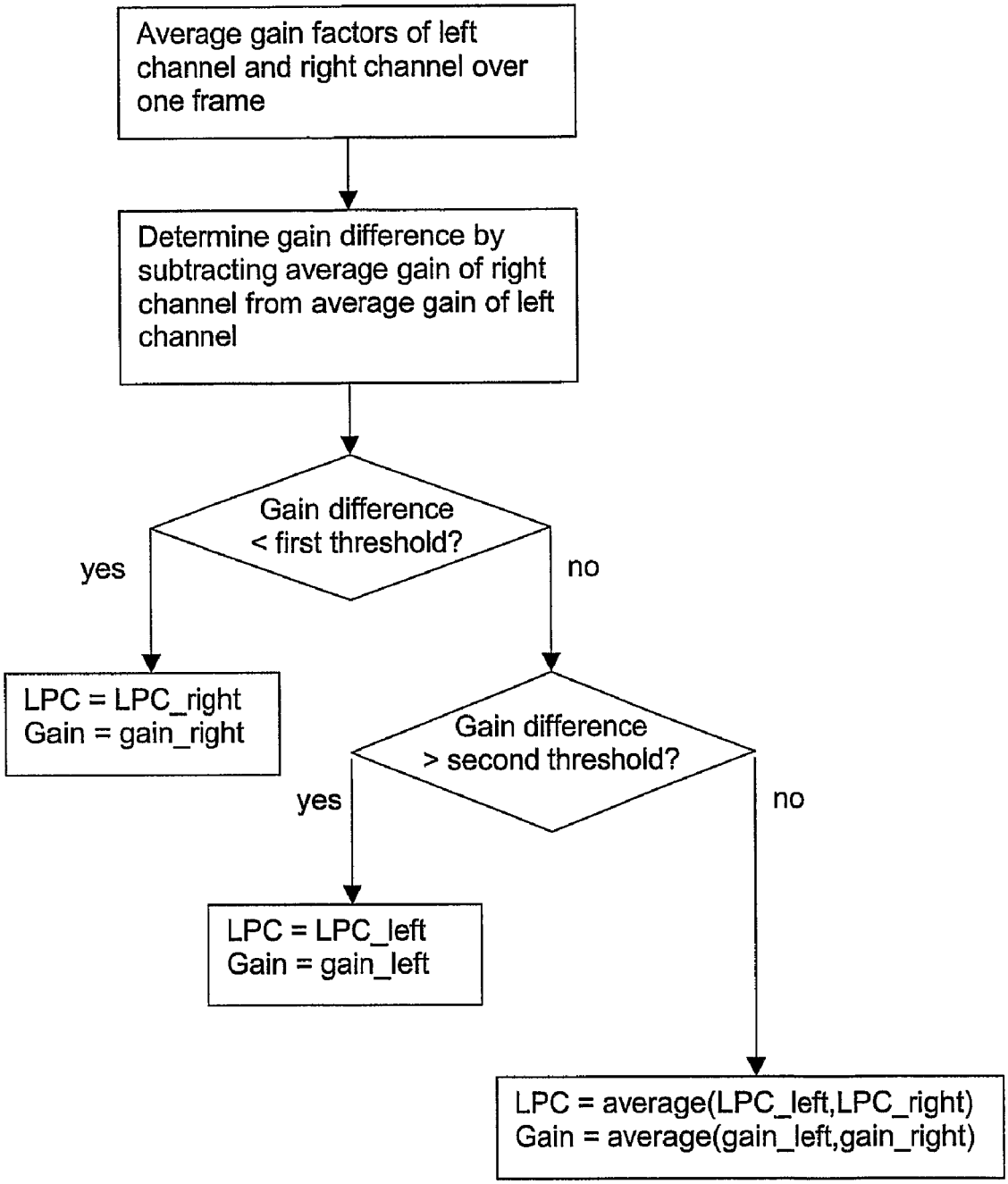
FIG. 8 is a flow chart illustrating a first option for the parameter combining in the flow chart of FIG. 7.

In the first option illustrated in FIG. 8, the gain factors for the left channel are first averaged over the duration of one frame, and equally, the gain factors for the right channel are averaged over the duration of one frame.

The averaged right channel gain is then subtracted from the averaged left channel gain, resulting in a certain gain difference for each frame.

In case the gain difference is smaller than a first threshold value, the combined gain factors for this frame are set equal to the gain factors provided for the right channel. Moreover, the combined LPC models for this frame are set to be equal to the LPC models provided for the right channel.

In case the gain difference is larger than a second threshold value, the combined gain factors for this frame are set equal to the gain factors provided for the left channel. Moreover, the combined LPC models for this frame are set to be equal to the LPC models provided for the left channel.

In all other cases, the combined gain factors for this frame are set equal to the average over the respective gain factor for the left channel and the respective gain factor for the right channel. The combined LPC models for this frame are set to be equal to the average over the respective LPC model for the left channel and the respective LPC model for the right channel.

The first threshold value and the second threshold value are selected depending on the required sensitivity and the type of the application for which the stereo to mono conversion is required. Suitable values are for example −20 dB for the first threshold value and 20 dB for the second threshold value.

Thus, if one of the channels can be considered as a silent channel while the other channel can be considered as an active channel during a respective frame, due to the large differences in the average gain factors, the gain factors and LPC models of the silent channel are disregarded for the duration of the frame. This is possible, as the silent channel has no audible contribution to the mixed audio output. Such a combination of parameter values ensures that the spectral characteristics and the signal level are as close as possible to the respective active channel.

It has to be noted that instead of omitting the stereo parameters, also the low band decoder could form combined parameter values and apply them to the mono part of the signal, just as described for the high frequency band processing.

Figure 9:
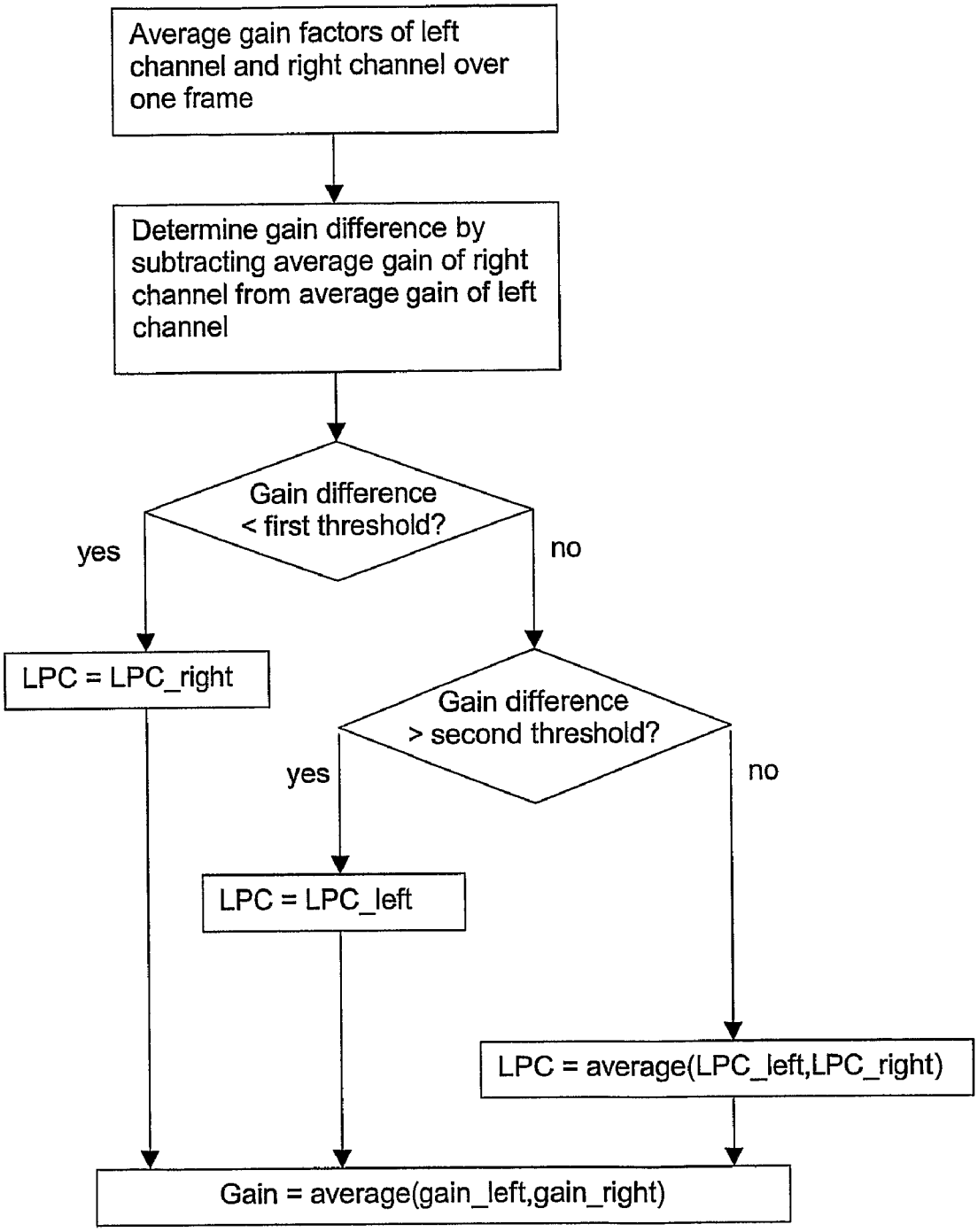
FIG. 9 is a flow chart illustrating a second option for the parameter combining in the flow chart of FIG. 7.

In the second option of combining parameter values illustrated in FIG. 9, the gain factors for the left channel and the gain factors for the right channel, respectively, are averaged as well over the duration of one frame.

The averaged right channel gain is then subtracted from the averaged left channel gain, resulting in a certain gain difference for each frame.

In case the gain difference is smaller than a first, low threshold value, the combined LPC models for this frame are set to be equal to the provided LPC models for the right channel.

In case the gain difference is larger than a second, high threshold value, the combined LPC models for this frame are set to be equal to the provided LPC models for the left channel.

In all other cases, the combined LPC models for this frame are set to be equal to the average over the respective LPC model for the left channel and the respective LPC model for the right channel.

The combined gain factors for the frame are set in any case equal to the average over the respective gain factor for the left channel and the respective gain factor for the right channel.

The LPC coefficients have a direct effect only on the spectral characteristics of the synthesized signal. Combining only the LPC coefficients thus results in the desired spectral characteristics, but does not solve the problem of the signal attenuation. This has the advantage, however, that the balance between the low frequency band and the high frequency band is preserved, in case the low frequency band is not mixed in accordance with the invention. Preserving the signal level at the high frequency band would change the balance between the low frequency bands and the high frequency bands by introducing relatively too loud signals in the high frequency band, which leads to a possibly reduced subjective audio quality.

It has to be noted that the described embodiments are only some of a wide variety embodiments which can further be amended in many ways.

The invention claimed is:

1. A method:

combining parameter values of multiple channels of an encoded multichannel audio signal in a parameter domain at least for a part of an audio frequency band, the encoded multichannel audio signal comprising at least for the part of the audio frequency band separate parameter values for each channel of said multichannel audio signal; and using said combined parameter values for synthesizing a mono audio signal at least for a part of the audio frequency band;

wherein said combining said parameter values is controlled for at least one parameter based on information on the respective activity in said multiple channels.

2. The method according to claim 1, wherein said parameters comprise gain factors for each of said multiple channels and linear prediction coefficients for each of said multiple channels.

3. The method according to claim 1, wherein said information on the respective activity in said multiple channels includes at least one of:

a gain factor for each of said multiple channels;

a combination of gain factors over a short period of time for each of said multiple channels;

linear prediction coefficients for each of said multiple channels;

an energy level in at least part of the frequency band of said multichannel audio signal for each of said multiple channels; and separate side information on said activity received from an encoding end providing said encoded multichannel audio signal.

4. The method according to claim 1, wherein in case said information on the activity in said multiple channels indicates that the activity in a first one of said multiple channels is considerably lower than in at least one other of said multiple channels, disregarding a value of at least one parameter which is available for said first channel.

5. The method according to claim 4, wherein in case said information on the activity in said multiple channels indicates that the activity in a first one of said multiple channels is considerably lower than in at least one other of said multiple channels, averaging the values of at least one other parameter which are available for said multiple channels.

6. The method according to claim 1, wherein in case said information on the activity in said multiple channels does not indicate that the activity in one of said multiple channels is considerably lower than in at least one other of said multiple channels, averaging the values of said parameters which are available for said multiple channels.

7. The method according to claim 1, wherein said multichannel signal is a stereo signal.

8. The method according to claim 1, comprising splitting an original multichannel audio signal into a low frequency band signal and a high frequency band signal, encoding said low frequency signal, and encoding said high frequency band signal separately for said multiple channels, resulting in said parameter values for each of said multiple channels, wherein at least the parameter values resulting for said high frequency band signal are combined for synthesizing said mono audio signal.

9. An apparatus comprising:

at least one parameter selection portion configured to combine parameter values of multiple channels of an encoded multichannel audio signal in a parameter domain at least for a part of the frequency band of said multichannel audio signal, the encoded multichannel audio signal comprising at least for the part of the frequency band of the original multichannel audio signal separate parameter values for each channel of the multichannel audio signal; and an audio signal synthesis portion configured to synthesize a mono audio signal at least for a part of the frequency band of said multichannel audio signal based on combined parameter values provided by said at least one parameter selection portion;

wherein said parameter selection portion is configured to combine said parameter values for at least one parameter based on information on respective activity in said multiple channels.

10. The apparatus according to claim 9, wherein said parameters comprise gain factors for each of said multiple channels and linear prediction coefficients for each of said multiple channels.

11. The apparatus according to claim 9, wherein said information on the respective activity in said multiple channels includes at least one of:

a gain factor for each of said multiple channels;

a combination of gain factors over a short period of time for each of said multiple channels;

linear prediction coefficients for each of said multiple channels;

the energy level in at least part of the frequency band of said multichannel audio signal for each of said multiple channels; and separate side information on said activity received from an encoding end providing said encoded multichannel audio signal.

12. The apparatus according to claim 9, wherein said parameter selection portion is configured to disregard in combining a value of at least one parameter which is available for a first one of said multiple channels, in case said information on the activity in said multiple channels indicates that the activity in said a first channel is considerably lower than in at least one other of said multiple channels.

13. The apparatus according to claim 12, wherein said parameter selection portion is configured to average values of at least one other parameter which are available for said multiple channels in said combining in case said information on the activity in said multiple channels indicates that the activity in a first one of said multiple channels is considerably lower than in at least one other of said multiple channels.

14. The apparatus according to claim 9, wherein said parameter selection portion is configured to average values of said parameters which are available for said multiple channels in case said information on the activity in said multiple channels does not indicate that the activity in one of said multiple channels is considerably lower than in at least one other of said multiple channels.

15. The apparatus according to claim 9, wherein said multichannel signal is a stereo signal.

16. A coding system including an audio encoder providing an encoded multichannel audio signal, which encoded multichannel audio signal comprises at least for a part of a frequency band of an original multichannel audio signal separate parameter values for each channel of said multichannel audio signal, and an apparatus according to claim 9.

17. The coding system according to claim 16, wherein said audio encoder comprises an evaluating component configured to determine information on the activity in said multiple channels and configured to provide said information for use by said apparatus.

18. The apparatus according to claim 9, wherein the apparatus is one of an audio decoder and a mobile terminal.

19. A computer readable medium storing software code, the software code causing an apparatus to perform the following when executed in an audio decoder:

combine parameter values of multiple channels of an encoded multichannel audio signal in a parameter domain at least for a part of an audio frequency band, the encoded multichannel audio signal comprising at least for the part of the audio frequency band separate parameter values for each channel of said multichannel audio signal; and use said combined parameter values for synthesizing a mono audio signal at least for a part of the audio frequency band;

wherein control to combine said parameter values for at least one parameter is based on information on the respective activity in said multiple channels.

* * * * *